US010126713B2

(12) United States Patent
Cusin et al.

(10) Patent No.: US 10,126,713 B2
(45) Date of Patent: Nov. 13, 2018

(54) TIMEPIECE COMPONENT WITH A PART WITH A DECOUPLED WELDING SURFACE

(71) Applicant: Nivarox-FAR S.A., Le Locle (CH)

(72) Inventors: Pierre Cusin, Villars-Burquin (CH); Davy Cretenet, La Chaux-de-Gilley (FR); Marc Stranczl, Nyon (CH); Raphael Garret, La Chaux de Fonds (CH)

(73) Assignee: Nivarox-FAR S.A., Le Locle (CH)

( * ) Notice: Subject to any disclaimer, the term of this patent is extended or adjusted under 35 U.S.C. 154(b) by 0 days.

(21) Appl. No.: 15/175,763

(22) Filed: Jun. 7, 2016

(65) Prior Publication Data

US 2016/0370764 A1 Dec. 22, 2016

(30) Foreign Application Priority Data

Jun. 16, 2015 (EP) ..... 15172336

(51) Int. Cl.

| | |
|---|---|
| ***G04B 29/04*** | (2006.01) |
| ***G04B 15/14*** | (2006.01) |
| ***G04B 17/34*** | (2006.01) |
| ***G04B 13/02*** | (2006.01) |
| ***G04B 19/04*** | (2006.01) |

(52) U.S. Cl.

CPC ..... *G04B 29/04* (2013.01); *G04B 13/02* (2013.01); *G04B 15/14* (2013.01); *G04B 17/34* (2013.01); *G04B 19/044* (2013.01)

(58) Field of Classification Search

CPC ..... G04B 29/04; G04B 29/027; G04B 17/34; G04B 13/02; G04B 15/14; G04B 19/044

See application file for complete search history.

(56) References Cited

U.S. PATENT DOCUMENTS

| | | | | |
|---|---|---|---|---|
| 5,339,002 | A | 8/1994 | Braun et al. | |
| 6,528,931 | B1 | 3/2003 | Umehara et al. | |
| 7,344,303 | B2 * | 3/2008 | Conus | G04B 31/04 368/324 |
| 2003/0199165 | A1 * | 10/2003 | Keenan | A61B 17/32 438/689 |
| 2010/0110840 | A1 * | 5/2010 | Zaugg | G04D 3/0041 368/177 |
| 2011/0103200 | A1 | 5/2011 | Cusin | |
| 2013/0147102 | A1 | 6/2013 | Mann | |

(Continued)

FOREIGN PATENT DOCUMENTS

| | | |
|---|---|---|
| CH | 698 677 B1 | 9/2009 |
| CH | 700 585 B1 | 9/2010 |

(Continued)

OTHER PUBLICATIONS

European Search Report dated Mar. 16, 2016 in European application 15172336.8, filed on Jun. 16, 2015(with English Translation).

*Primary Examiner* — Sean Kayes
(74) *Attorney, Agent, or Firm* — Oblon, McClelland, Maier & Neustadt, L.L.P.

(57) ABSTRACT

The invention relates to a timepiece component with a part comprising elastic attachment means and securing means arranged to be welded enabling the attachment of the elastic means to be decoupled from the securing means to ensure the welding of the timepiece component.

12 Claims, 7 Drawing Sheets

(56) References Cited

U.S. PATENT DOCUMENTS

| | | | | |
|---|---|---|---|---|
| 2014/0313866 | A1* | 10/2014 | Hessler | H03H 3/0076 368/202 |
| 2015/0023140 | A1 | 1/2015 | Daout et al. | |
| 2015/0198926 | A1* | 7/2015 | Girardin | G04B 31/04 368/326 |

FOREIGN PATENT DOCUMENTS

| | | | |
|---|---|---|---|
| EP | 2 317 406 | A1 | 5/2011 |
| WO | WO 2013/028923 | A1 | 2/2013 |

* cited by examiner

TIMEPIECE COMPONENT WITH A PART WITH A DECOUPLED WELDING SURFACE

This application claims priority from European Patent Application No. 15172336.8 filed Jun. 16, 2015, the entire disclosure of which is incorporated herein by reference.

FIELD OF THE INVENTION

The invention relates to a part with an improved welding surface and, more specifically, such a part whose surface can be adapted for improved welding.

BACKGROUND OF THE INVENTION

It is known from WO Publication 2015/185423 how to form a timepiece component from a part comprising a silicon-based or ceramic-based material which is welded by electromagnetic radiation directly onto another part, such as, for example, a metal or a metal alloy.

In the context of this development, it transpired that it was important for the gap between the parts not to exceed 0.5 micrometer, otherwise they could not be welded together.

SUMMARY OF THE INVENTION

It is an object of the present invention to overcome all of part of aforecited drawbacks by proposing a timepiece component comprising a new part with at least one contact surface that allows for geometric adaptation to ensure the assembly thereof by welding to another member.

To this end, the invention relates to a timepiece component comprising a one-piece part welded on a member provided with a substantially horizontal surface and a substantially vertical surface, characterized in that the one-piece part includes elastic means of attachment to said substantially vertical surface and in that the one-piece part further includes securing means arranged to be welded on said substantially horizontal surface enabling the attachment of the elastic means to be decoupled from the securing means to ensure the welding of the timepiece component.

Advantageously according to the invention, the timepiece component includes a one-piece part comprising elastic attachment means enabling centring relative to a member, which are separate from securing means, which are intended to be welded on the member and adapt to the geometry of the member to decrease the gap below 0.5 micrometer and, incidentally, ensure the welding of the timepiece component.

In accordance with other advantageous variants of the invention:

- the one-piece part includes a strip extending in a closed curve, the space delimited by the closed curve receiving the member;
- the elastic means are formed by said strip, whose closed curve offers areas of elastic deformation that come into contact with said substantially vertical surface in order to attach the one-piece part;
- the elastic means are formed by bars integral with said strip extending in said space delimited by the closed curve and offering areas of elastic deformation that come into contact with said substantially vertical surface in order to attach the one-piece part;
- the securing means are formed by said strip, whose closed curve offers elastic deformation portions that only come into contact with said substantially horizontal surface in order to adapt to the geometry and ensure the welding thereof;

- the securing means are formed by branches integral with said strip extending inside said space delimited by the closed curve and offering elastic deformation portions that only come into contact with said substantially horizontal surface in order to adapt to the geometry and to ensure the welding thereof;
- the securing means are formed by branches integral with said strip extending outside said space delimited by the closed curve and offering elastic deformation portions that only come into contact with said substantially horizontal surface in order to adapt to the geometry and to ensure the welding thereof;
- the one-piece part is made from silicon or from ceramic;
- the one-piece part also includes at least a partial coating of metal, silicon oxide, silicon nitride, silicon carbide or an allotrope of carbon;
- the member includes an iron alloy, a copper alloy, nickel or an alloy thereof, titanium or an alloy thereof, gold or an alloy thereof, silver or an alloy thereof, platinum or an alloy thereof, ruthenium or an alloy thereof, rhodium or an alloy thereof, or palladium or an alloy thereof.

Moreover, the invention relates to a timepiece, characterized in that it includes at least one timepiece component according to any of the preceding variants.

BRIEF DESCRIPTION OF THE DRAWINGS

Other features and advantages will appear clearly from the following description, given by way of non-limiting illustration, with reference to the annexed drawings, in which.

DETAILED DESCRIPTION OF PREFERRED EMBODIMENTS

The invention relates to a timepiece component formed with the aid of a part whose material has no usable plastic range i.e. a very limited plastic range, and another part comprising the same type of material or a different type of material.

This component was devised for applications in the field of horology and is rendered necessary by the increasing part played by fragile, brittle materials, such as silicon-based or ceramic-based materials. It is possible, for example, to envisage forming a case, a dial, a flange, a crystal, a bezel, a push-button, a crown, a case back, a hand, a bracelet or strap, a balance spring, a balance wheel, a pallets, a bridge or bar, an oscillating weight or even a wheel, such as an escape wheel, entirely or partially from fragile or brittle materials.

Preferably, the silicon-based material used to make the compensated balance spring may be single crystal silicon, regardless of its crystal orientation, doped single crystal silicon, regardless of its crystal orientation, amorphous silicon, porous silicon, polycrystalline silicon, silicon nitride, silicon carbide, quartz, regardless of its crystal orientation, or silicon oxide. Of course, other materials may be envisaged, such as glass, ceramics, cermets, metals or metal alloys. Further, the first silicon-based part may also optionally include at least one partial coating of silicon oxide, silicon nitride, silicon carbide or an allotrope of carbon, depending upon the intended applications of the timepiece component.

As explained above, the other part may include the same type of material or another type of material. Therefore, preferably, the other part is metal-based and may include an iron alloy, a copper alloy, nickel or an alloy thereof, titanium or an alloy thereof, gold or an alloy thereof, silver or an alloy thereof, platinum or an alloy thereof, ruthenium or an alloy thereof, rhodium or an alloy thereof, or palladium or an alloy thereof.

Figure 1:
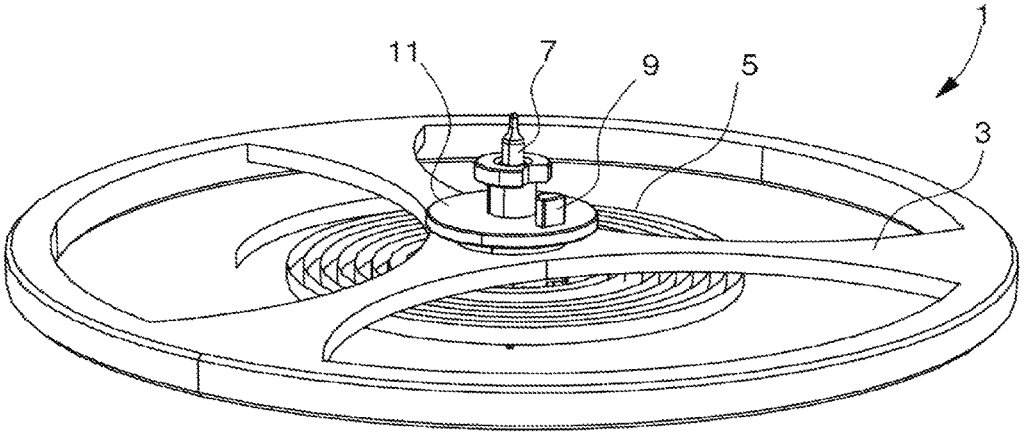
FIG. 1 is a perspective view of a sprung balance resonator.

For the sake of simplicity, the explanation below will concern an assembly between a balance spring and a balance staff. FIG. 1 shows a resonator 1 wherein the balance spring 5 is used for temperature compensation of the entire resonator assembly 1, i.e. all the parts and particularly the balance wheel 3 mounted on the same balance staff 7. Resonator 1 cooperates with a maintenance system, such as, for example, a Swiss lever escapement (not shown) cooperating with the impulse pin 9 of table-roller 11 which is also mounted on staff 7.

Figure 2:
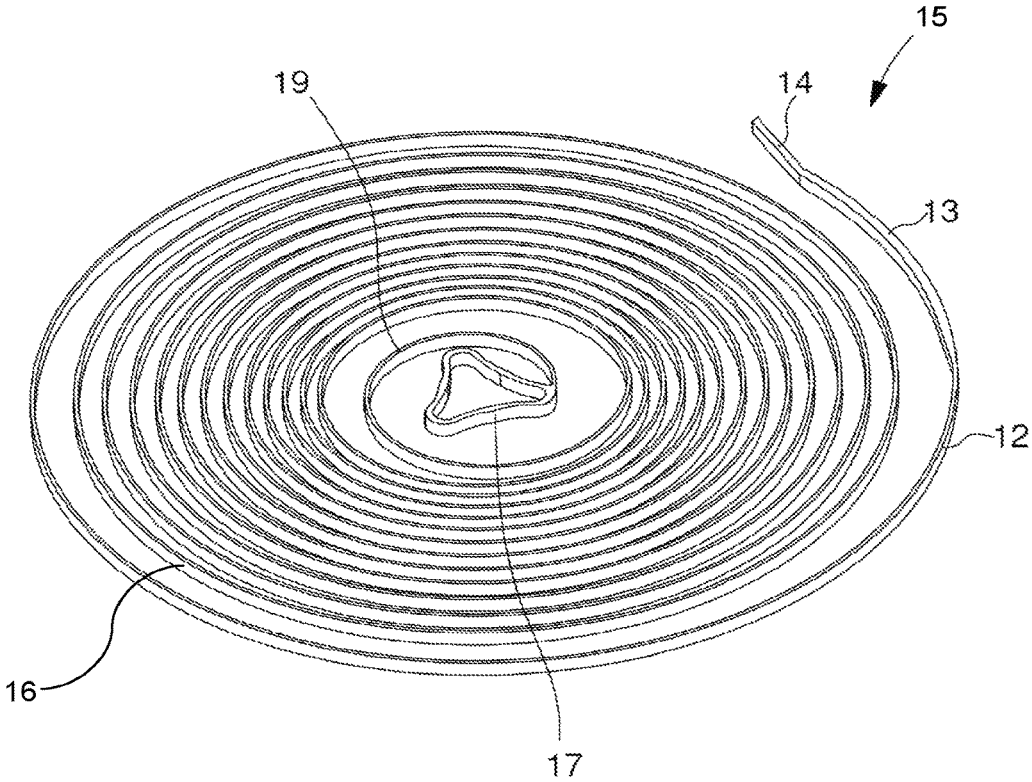
FIG. 2 is a perspective view of a balance spring according to the invention.

A compensating balance spring 15 is shown more clearly in FIG. 2. It includes a single strip 16 wound on itself between an inner coil 19 integral with a collet 17 and an outer coil 12 comprising an end 14 intended to be pinned up to the stud. As seen in FIG. 2, in order to improve the isochronism of the resonator in which balance spring 15 is used, the latter includes an inner coil 19 comprising a Grossmann curve and an outer coil 12 comprising a portion 13 that is thickened relative to the rest of balance spring 15. Finally, it can be seen that collet 17 comprises a single strip extending in a substantially triangular shape so that the collet exhibits elasticity when it is fitted onto the staff, in particular to enable it to be centred relative to the staff.

Figure 3:
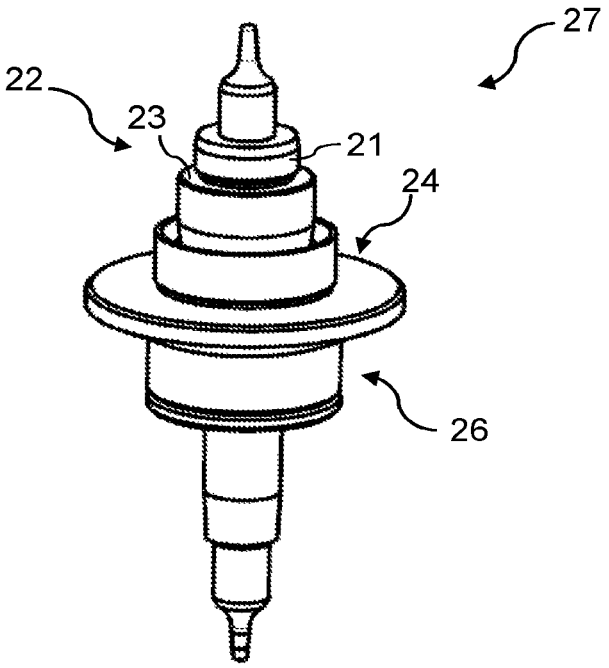
FIG. 3 is a perspective view of a balance staff according to the invention.

A staff 27 is illustrated more clearly in FIG. 3. It includes, in particular, several diameter portions 22, 24, 26 respectively intended to receive the balance spring, the balance wheel and the table-roller. As illustrated in FIG. 3, diameter portion 22 includes a cylindrical shaft 21, the lower portion of which is edged with a shoulder 23.

Figure 4:
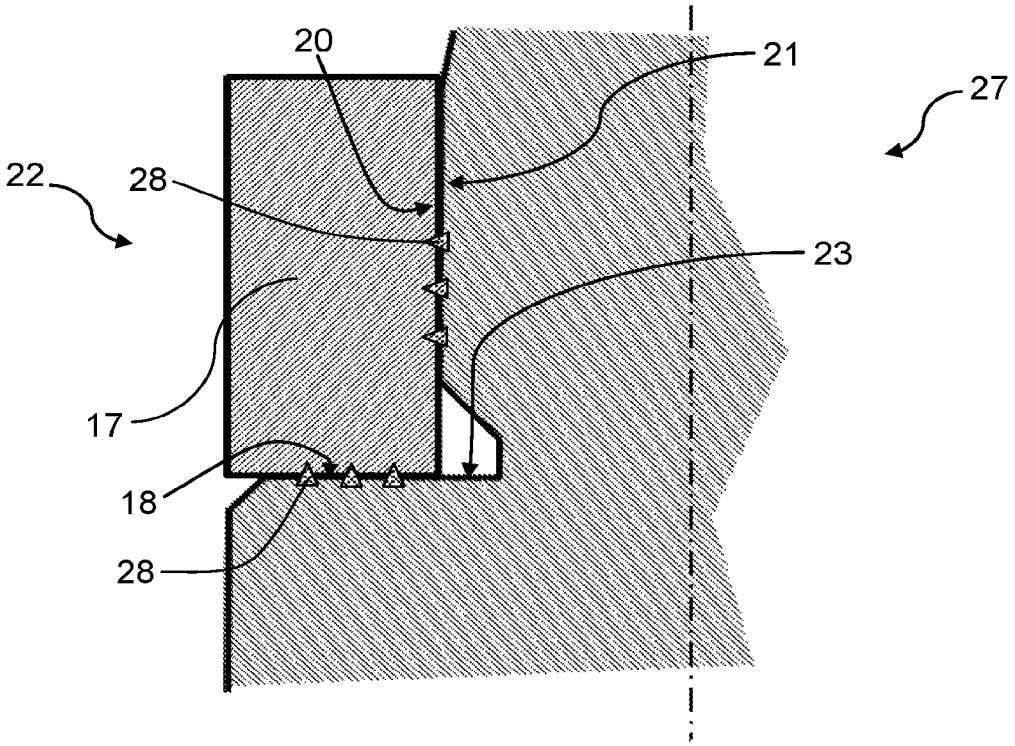
FIG. 4 is a cross-sectional view of an assembly according to WO Publication 2015/185423.

As illustrated in FIG. 4, diameter portion 22 is intended to receive, between shaft 21 and shoulder 23, collet 17 of balance spring 15. More specifically, the inner face 20 of collet 17 is resiliently pressed against the outer surface of shaft 21 and the lower face 18 of collet 17 is pressed against shoulder 23. Finally, as seen at reference 28, shaft 21 and/or shoulder 23 is welded to collet 17 in accordance with the teaching of WO Publication 2015/185423.

However, within the context of developing the teaching of WO Publication 2015/185423, it very soon became clear that the gap between the parts must not exceed 0.5 micrometer, otherwise they cannot be welded together.

According to the embodiments of the invention described below, the timepiece component includes one part comprising attachment means, enabling centring relative to a member, which are separated from securing means, intended to be welded on the member which, advantageously according to the invention, adapt to the geometry of the member to decrease said gap below 0.5 micrometer and, incidentally, ensure the welding of the timepiece component.

Advantageously according to the invention, the one-piece part 35, 45, 55, 65, 75 includes elastic means 30, 40, 50, 60, 70 of attachment to said substantially vertical surface forming a shaft 21 and securing means 36, 46, 56, 66, 76 arranged to be welded on said substantially horizontal surface forming a shoulder 23. It is thus understood that the one-piece part forming a balance spring 35, 45, 55, 65, 75 enables the decoupling between, on the one hand, the attachment of the elastic means 30, 40, 50, 60, 70 enabling centring on shaft 21 and, on the other hand, the securing means 36, 46, 56, 66, 76 which are used to ensure the welding of the timepiece component between the lower area 32, 42, 52, 62, 72 of the securing means 36, 46, 56, 66, 76 and shoulder 23 of staff 27.

Further, the one-piece balance spring part 35, 45, 55, 65, 75 includes a strip 37, 47, 57, 67, 77 extending in a closed curve 33, 43, 53, 63, 73, the space delimited by the closed curve 33, 43, 53, 63, 73 forming a collet for receiving the member formed by staff 27.

Figure 5:
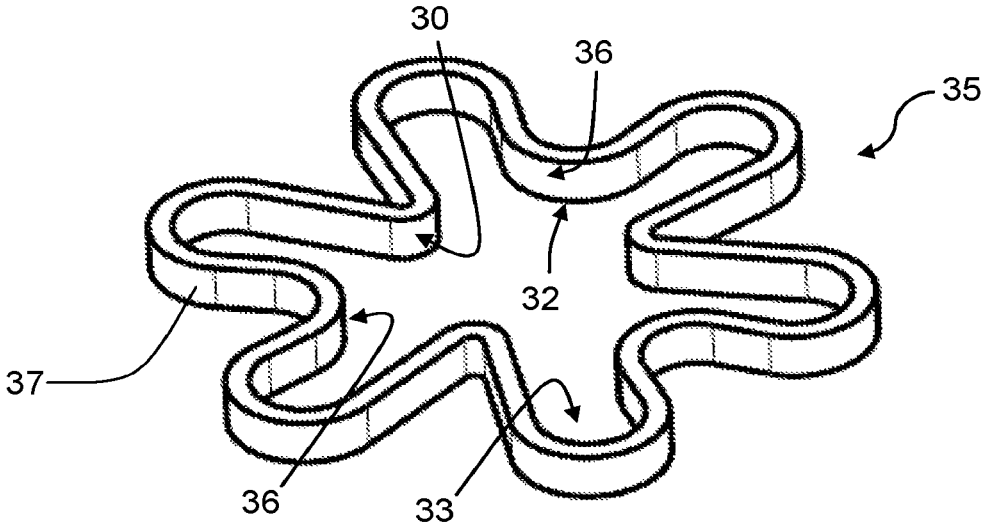
FIGS. 5 and 6 are diagrams of a first embodiment of the timepiece component according to the invention.
Figure 6:
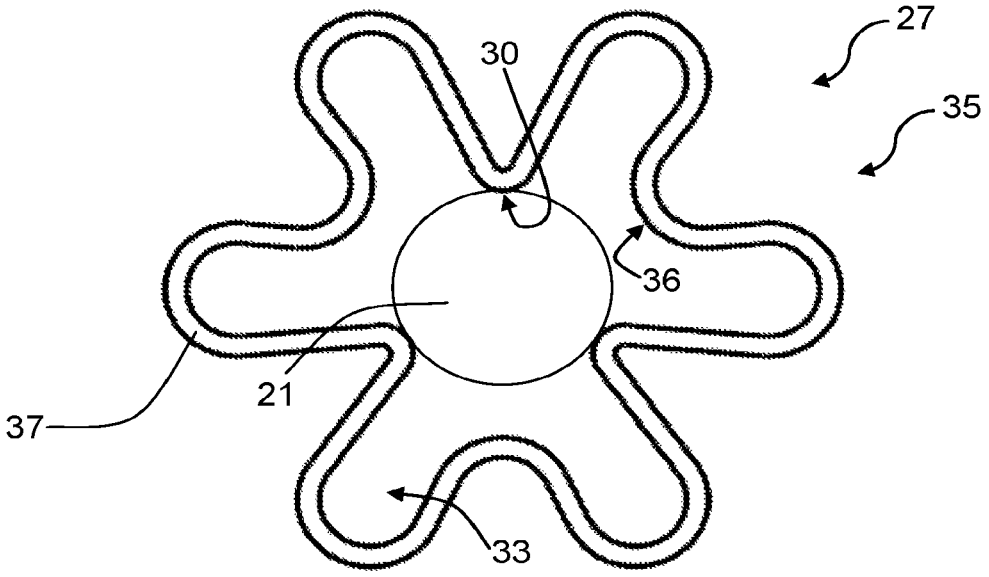

According to a first embodiment illustrated in FIGS. 5 and 6, the invention relates to a component comprising a one-piece part forming a balance spring 35 welded on a member forming a staff 27 provided with a substantially horizontal surface forming a shoulder 23 and a substantially vertical surface forming a shaft 21.

Advantageously according to the first embodiment, it can be seen in FIGS. 5 and 6 that the elastic means 30 are formed by the strip 37 whose closed curve 33 substantially forms a star and offers elastic deformation areas that come into contact with said substantially vertical surface forming a shaft 21 in order to attach the one-piece balance spring part 35.

Further, the securing means are also formed by said strip 37 whose closed curve 33 offers elastic deformation portions 36, each lower surface 32 of elastic deformation portions 36 is only intended to come into contact with said substantially horizontal surface forming a shoulder 23 in order to adapt to its geometry so as to ensure the welding thereof.

It is thus understood that lower face 32 is capable of deforming to compensate for any unevenness of the shoulder 23, i.e. lower face 32 can follow the geometry of shoulder 23 with more degrees of freedom, in order to reduce the gap to a value less than or equal to 0.5 micrometer.

Thus, after the one-piece balance spring part 35 is fitted onto diameter portion 22 of staff 27, laser welding is ensured since elastic deformation portions of the securing means 36 can decrease the gap with member 27 to a value less than or equal to 0.5 micrometer.

Figure 7:
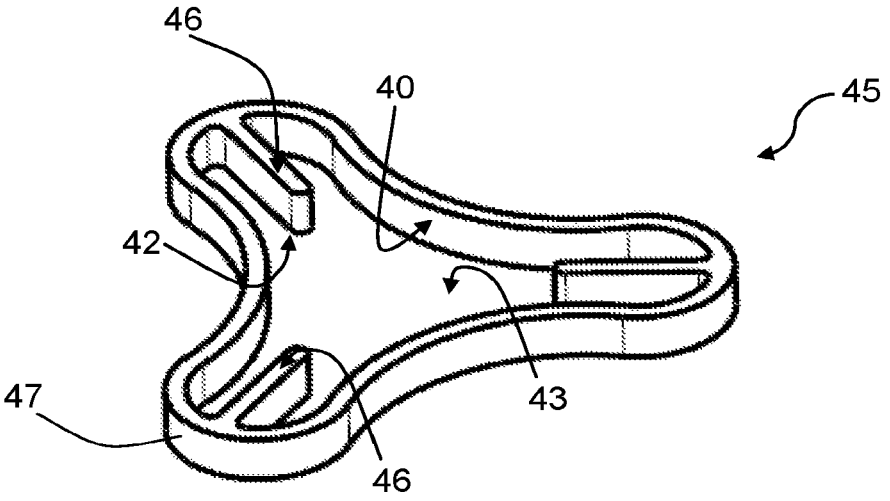
FIGS. 7 and 8 are diagrams of a second embodiment of the timepiece component according to the invention.
Figure 8:
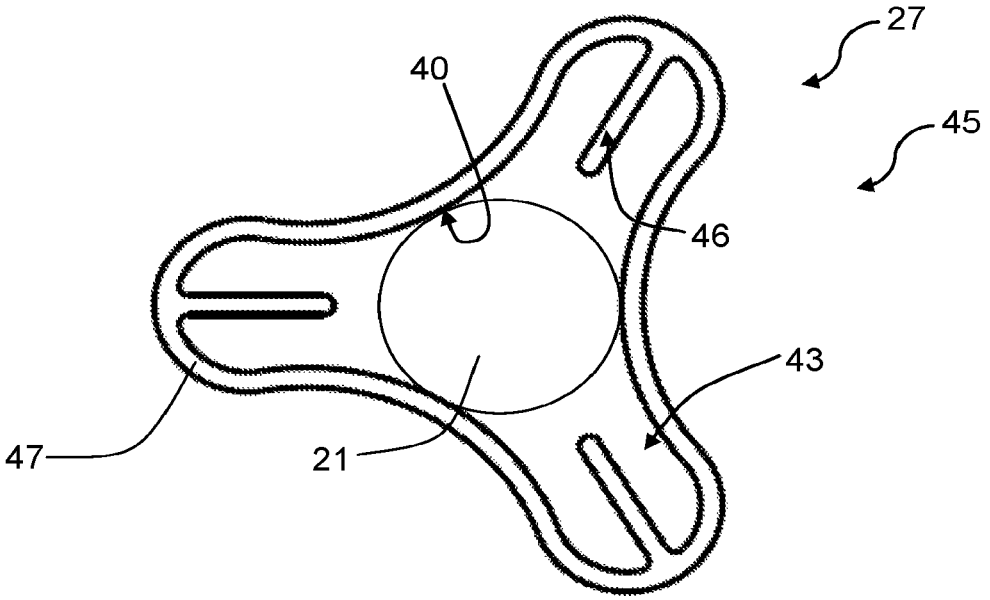

Advantageously according to a second embodiment of the invention, it can be seen in FIGS. 7 and 8 that the elastic means 40 are formed by strip 47 whose closed curve 43 substantially forms a trefoil with three lobes and offers elastic deformation areas that come into contact with said substantially vertical surface forming a shaft 21 in order to attach the balance spring part 45.

Further, the securing means 46 are formed by branches integral with strip 47 extending inside the space delimited by closed curve 43 and offering elastic deformation portions, each lower surface 42 of the securing means 46 is only intended to come into contact with said substantially horizontal surface forming shoulder 23 in order to adapt to its geometry so as to ensure the welding thereof.

It is thus understood that lower face 42 is capable of deforming to compensate for any unevenness of the shoulder 23, i.e. lower face 42 can follow the geometry of shoulder 23 with more degrees of freedom, in order to reduce the gap to a value less than or equal to 0.5 micrometer.

Thus, after the one-piece balance spring part 45 is fitted onto diameter portion 22 of staff 27, laser welding is ensured since elastic deformation portions of the securing means 46 can decrease the gap with member 27 to a value less than or equal to 0.5 micrometer.

Figure 9:
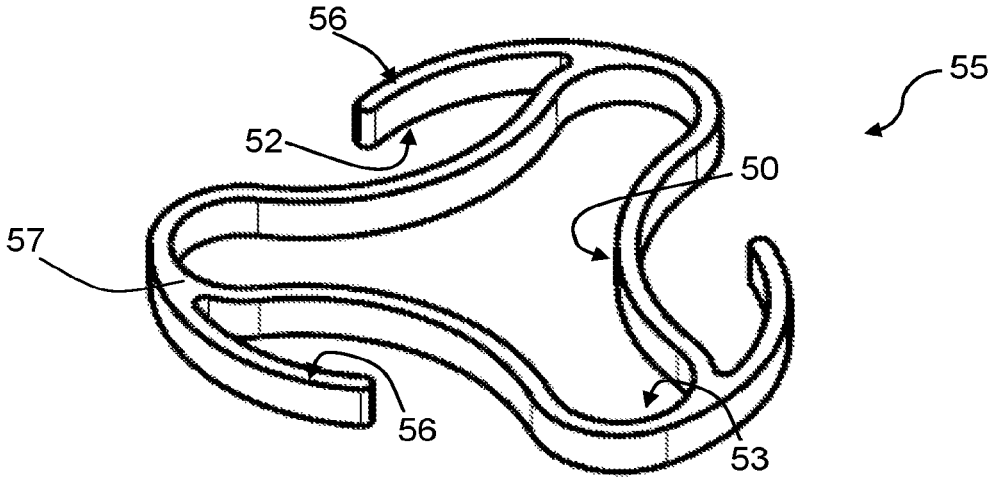
FIGS. 9 and 10 are diagrams of a third embodiment of the timepiece component according to the invention.
Figure 10:
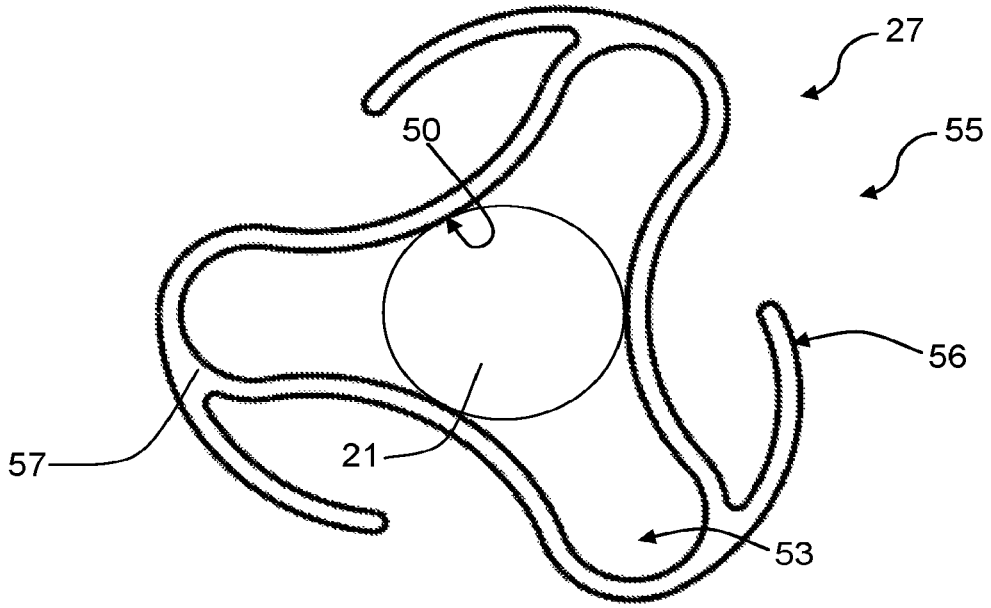

Advantageously according to a third embodiment of the invention, it can be seen in FIGS. 9 and 10 that the elastic means 50 are formed by strip 57 whose closed curve 53 substantially forms a trefoil with three lobes and offers elastic deformation areas that come into contact with said substantially vertical surface forming a shaft 21 in order to attach the one-piece balance spring part 55.

Further, the securing means 56 are formed by branches integral with strip 57 extending outside the space delimited by closed curve 53 and offering elastic deformation portions, each lower surface 52 of the securing means 56 is only intended to come into contact with said substantially horizontal surface forming shoulder 23 in order to adapt to its geometry so as to ensure the welding thereof.

It is thus understood that lower face 52 is capable of deforming to compensate for any unevenness of the shoulder 23, i.e. lower face 52 can follow the geometry of shoulder 23 with more degrees of freedom, in order to reduce the gap to a value less than or equal to 0.5 micrometer.

Thus, after the one-piece balance spring part 55 is fitted onto diameter portion 22 of staff 27, laser welding is ensured since elastic deformation portions of the securing means 56 can decrease the gap with member 27 to a value less than or equal to 0.5 micrometer.

According to a variant of the embodiment of FIGS. 9 and 10, branches of the securing means 56 forming elastic deformation portions could be doubled, i.e. formed on each side of the apex of the closed curve 53 of strip 57 and not only on one side as in the example of FIGS. 9 and 10.

Figure 11:
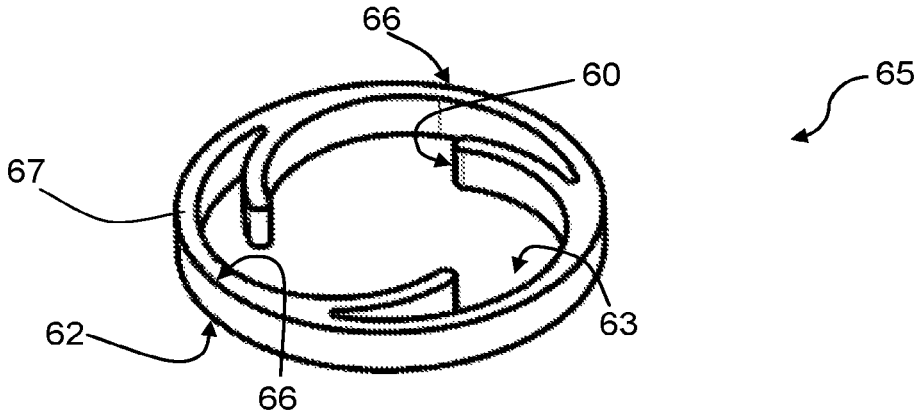
FIGS. 11 and 12 are diagrams of a fourth embodiment of the timepiece component according to the invention.
Figure 12:
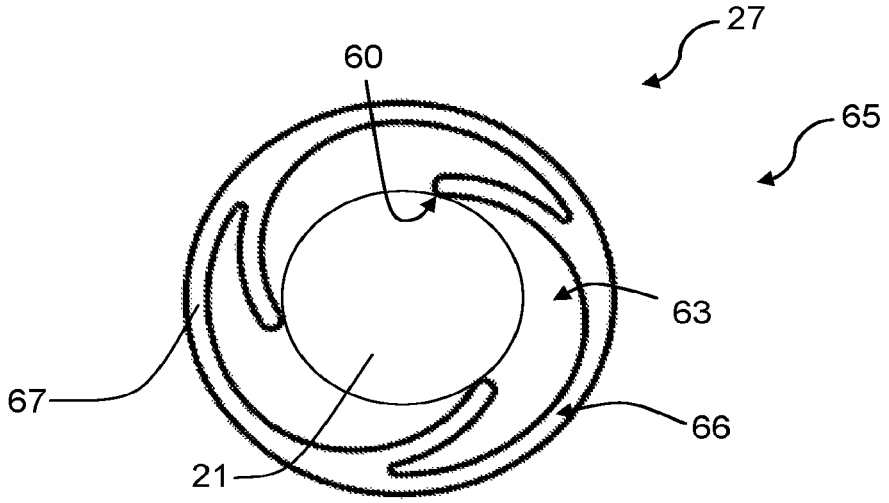

Advantageously according to a fourth embodiment, it can be seen in FIGS. 11 and 12 that the elastic means 60 are formed by bars integral with strip 67 extending in the space delimited by closed curve 63 and offering elastic deformation areas that come into contact with said substantially vertical surface forming shaft 21 in order to attach the one-piece balance spring part 65.

Further, the securing means 66 are formed by strip 67, whose closed curve 63 substantially forms a ring and offers elastic deformation portions that only come into contact with said substantially horizontal surface forming shoulder 23 in order to adapt to its geometry so as to ensure the welding thereof.

It is thus understood that lower face 62 is capable of compensating for any unevenness of the shoulder 23, i.e. lower face 62 can follow the geometry of shoulder 23 with more degrees of freedom, in order to reduce the gap to a value less than or equal to 0.5 micrometer.

Thus, after the one-piece balance spring part 65 is fitted onto diameter portion 22 of staff 27, laser welding is ensured since the geometry of the one-piece part 65 can decrease the gap with member 27 to a value less than or equal to 0.5 micrometer.

Figure 13:
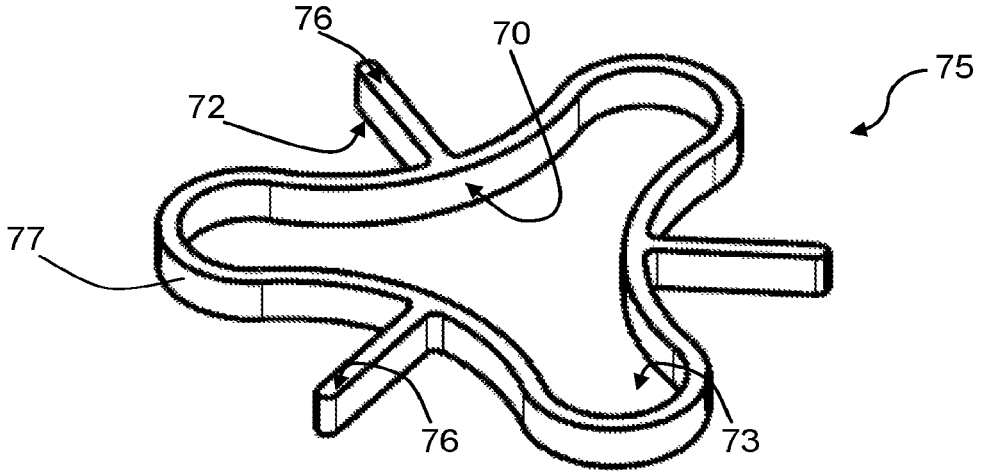
FIGS. 13 and 14 are diagrams of a fifth embodiment of the timepiece component according to the invention.
Figure 14:
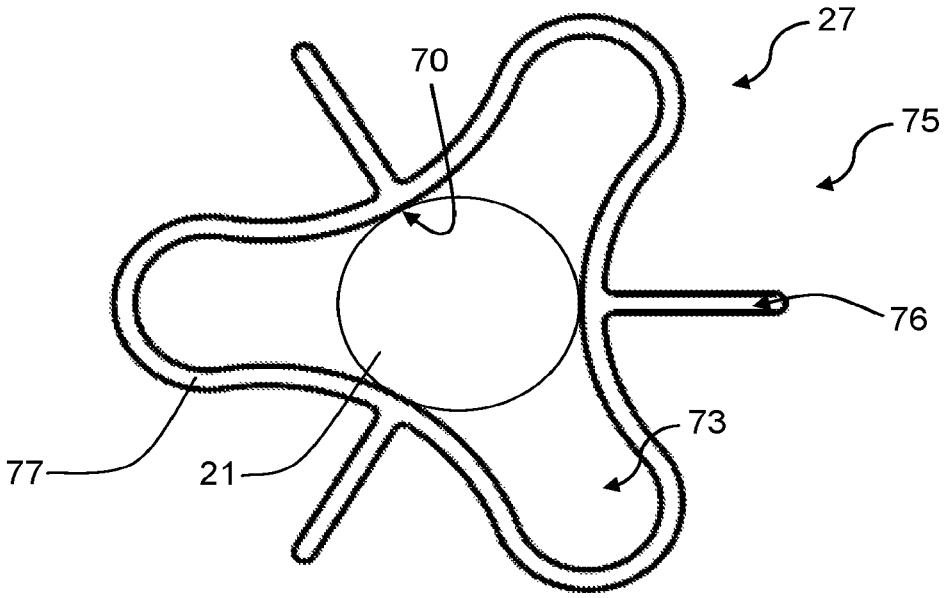

Advantageously according to a fifth embodiment of the invention, it can be seen in FIGS. 13 and 14 that the elastic means 70 are formed by strip 77 whose closed curve 73 substantially forms a trefoil with three lobes and offers elastic deformation areas that come into contact with said substantially vertical surface forming a shaft 21 in order to attach the balance spring part 75.

Further, the securing means 76 are formed by branches integral with strip 77 extending outside the space delimited by closed curve 73 and offering elastic deformation portions, each lower surface 72 of which is only intended to come into contact with said substantially horizontal surface forming shoulder 23 in order to adapt to its geometry so as to ensure the welding thereof.

It is thus understood that lower face 72 is capable of deforming to compensate for any unevenness of the shoulder 23, i.e. lower face 72 can follow the geometry of shoulder 23 with more degrees of freedom, in order to reduce the gap to a value less than or equal to 0.5 micrometer.

Thus, after the one-piece balance spring part 75 is fitted onto diameter portion 22 of staff 27, laser welding is ensured since elastic deformation portions of the securing means 76 can decrease the gap with member 27 to a value less than or equal to 0.5 micrometer.

Of course, the present invention is not limited to the illustrated example but is capable of various variants and modifications which will appear to those skilled in the art. In particular, the timepiece component is not limited to the embodiments set out in the present specification. Indeed, depending on the desired applications, it could be of different geometry to obtain different surfaces.

What is claimed is:

1. A timepiece component comprising:

a one-piece part welded on a member provided with a substantially horizontal surface and a substantially vertical surface, the one-piece part including a strip extending in a closed curve, the space delimited by the closed curve receiving the member, wherein a lower portion of the substantially vertical surface is in direct contact with the substantially horizontal surface, wherein the one-piece part includes a first plurality of elastic deformation portions and a second plurality of elastic deformation portions, wherein said elastic deformation portions of said first plurality are attached to the substantially vertical surface, and wherein said elastic deformation portions of said second plurality are welded on the substantially horizontal surface and not in direct contact with said substantially vertical surface.

2. The timepiece component according to claim 1, wherein said first plurality of elastic deformation portions are formed by the strip whose closed curve offers elastic deformation areas that come into contact with the substantially vertical surface.

3. The timepiece component according to claim 1, wherein said first plurality of elastic deformation portions are formed by bars integral with the strip, extending inside the space delimited by the closed curve and offering elastic deformation areas that come into contact with the substantially vertical surface.

4. The timepiece component according to claim 1, wherein said second plurality of elastic deformation portions are formed by the strip whose closed curve offers elastic deformation portions that only come into contact with the substantially horizontal surface.

5. The timepiece component according to claim 1, wherein said second plurality of elastic deformation portions are formed by branches integral with the strip, extending into the space delimited by the closed curve and offering elastic deformation portions that only come into contact with the substantially horizontal surface.

6. The timepiece component according to claim 1, wherein said second plurality of elastic deformation portions are formed by branches integral with the strip, extending outside the space delimited by the closed curve and offering elastic deformation portions that only come into contact with the substantially horizontal surface.

7. The timepiece component according to claim 1, wherein the one-piece part is made from silicon or from ceramic.

8. The timepiece component according to claim 7, wherein the one-piece part also includes at least a partial coating of metal, silicon oxide, silicon nitride, silicon carbide or an allotrope of carbon.

9. The timepiece component according to claim 1, wherein the member includes an iron alloy, a copper alloy, nickel or an alloy thereof, titanium or an alloy thereof, gold or an alloy thereof, silver or an alloy thereof, platinum or an alloy thereof, ruthenium or an alloy thereof, rhodium or an alloy thereof, or palladium or an alloy thereof.

10. A timepiece wherein it includes at least one timepiece component according to claim 1.

11. The timepiece component according to claim 1, wherein the member is a staff having a shaft forming said substantially vertical surface, said staff further having a shoulder forming said substantially horizontal surface, said shaft being inserted through said one-piece part at said substantially vertical surface.

12. The timepiece component according to claim 1, wherein said second plurality of elastic deformation portions are deformable to adapt the one-piece part to the geometry of said substantially horizontal surface.

* * * * *